United States Patent [19]

Freese

[11] 4,153,117

[45] May 8, 1979

[54] CUSHION DOZER WITH THREE POINT ATTACHMENT SUPPORT

[75] Inventor: Gary P. Freese, Joliet, Ill.

[73] Assignee: Caterpillar Tractor Co., Peoria, Ill.

[21] Appl. No.: 837,966

[22] Filed: Sep. 29, 1977

[51] Int. Cl.[2] ..... E02F 3/76

[52] U.S. Cl. ..... 172/809

[58] Field of Search ..... 172/801, 803, 804, 806, 172/805, 809; 280/481; 267/63 R

[56] References Cited

U.S. PATENT DOCUMENTS

| | | | |
|---|---|---|---|
| 3,049,821 | 8/1962 | Lichti | 172/803 |
| 3,158,944 | 12/1964 | Rehberg | 172/803 |
| 3,234,670 | 2/1966 | Fryer | 172/803 |
| 3,238,647 | 3/1966 | Hall | 172/803 |
| 3,395,764 | 8/1968 | Wirt | 172/803 |
| 3,913,684 | 10/1975 | Casey | 172/804 |

*Primary Examiner*—Richard J. Johnson

*Attorney, Agent, or Firm*—Wegner, Stellman, McCord, Wiles & Wood

[57] ABSTRACT

A cushioned bulldozer blade mounting assembly is provided with a three-point support on the blade. The mounting assembly includes an upper and a lower frame, the upper frame being pivotally mounted at spaced apart points on the tractor frame and having a single sliding and pivoting connection with the upper midportion of the blade. Cushioning members carried by the upper frame are provided between the upper portion of the blade and said upper frame. The lower frame is connected to the track roller assembly and to the lower corners of the blade. The lower frame is comprised of two halves with the halves being provided with blade stabilizing mechanisms, such as a sliding center ball connection therebetween.

3 Claims, 5 Drawing Figures

FIG. 1
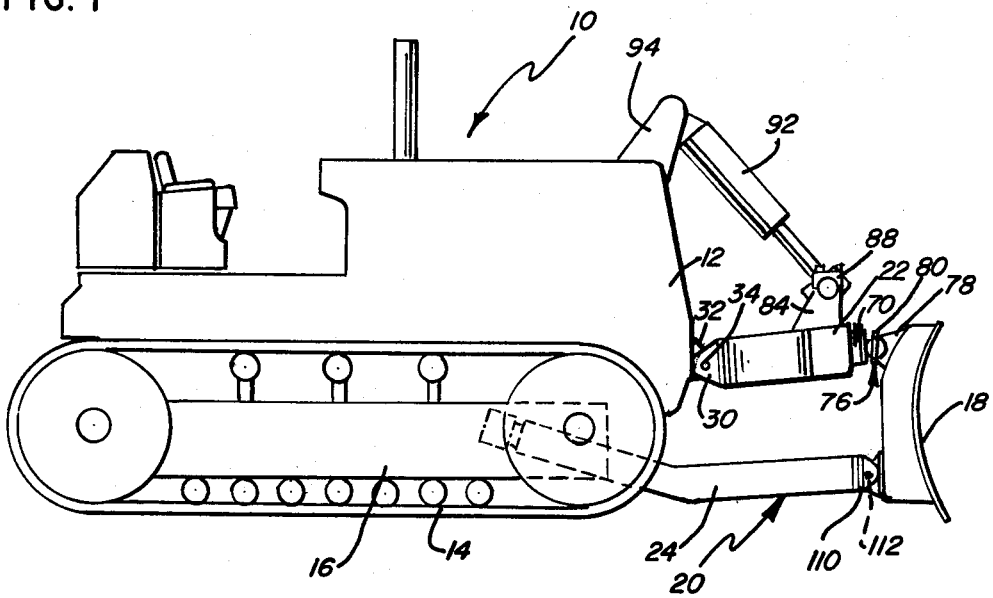
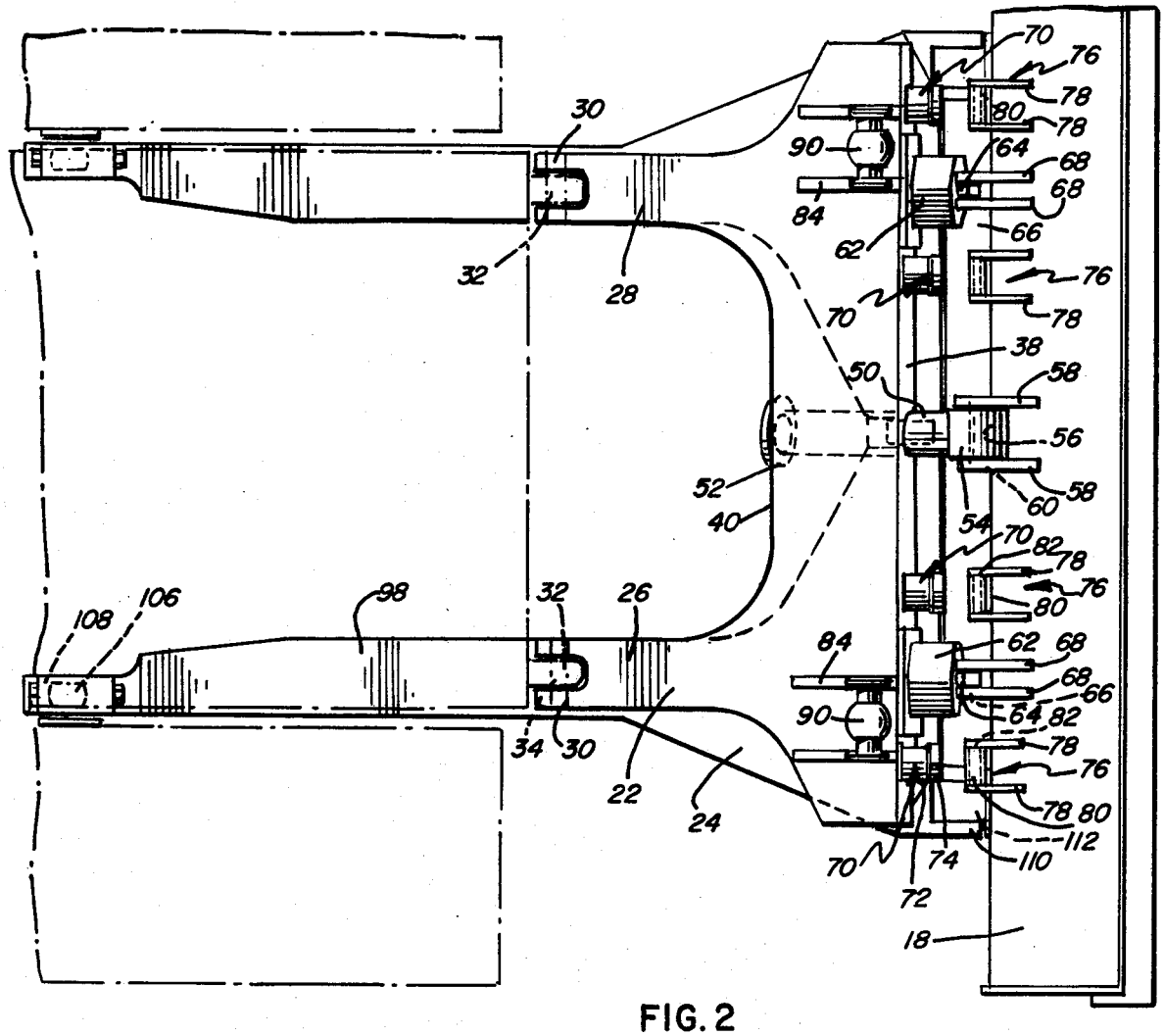
FIG. 2

CUSHION DOZER WITH THREE POINT ATTACHMENT SUPPORT

BACKGROUND OF THE INVENTION

1. Field of the Invention

This invention relates to tractors having cushioned bulldozer blades and, in particular, to a mounting assembly for a cushioned bulldozer blade.

2. Description of the Prior Art

Cushioned bulldozer blade mounting assemblies have been known and used for a considerable period of time. However, some currently available mounting assemblies have no cushioning in the mounting assembly between the blade and the tractor frame and have the mounting assembly connected directly from the blade to the tractor frame, such that undesirable "racking" of the frame results therefrom. Still other current mounting assemblies have cushioning means, but the connections for the mounting assemblies and cushioning means are directly between the blade and tractor frame.

All of these prior art devices have mounting assemblies with three or four connections directly between the tractor frame and the blade whereby a relatively rigid transmission of force through the mounting assembly creates increased loads on the pivot shaft between the roller frame and the tractor frame and creates increased loads on the tractor main frame.

SUMMARY OF THE INVENTION

The present invention is directed to overcoming one or more of the problems set forth above.

According to the present invention, a mounting assembly has an upper frame and a lower frame with the lower frame having two L-shaped halves pivotally mounted at one end to the track roller frame and at the other end to the lower corners of the blade. The two halves of the lower frame are connected together with a blade stabilizing mechanism, such as a sliding center ball connection. The upper frame has a C shape and has the legs of the "C" connected to the tractor frame and has a sliding and pivoting connection at the midportion of the "C" to the midportion of the bulldozer blade. Separate cushioning members are carried by the upper frame and provide for absorbing shocks and the like administered to the blade.

The sliding and pivoting connection between the blade and the upper frame and the two connections between the blade and the lower frame provide a three-point support for the blade. The connection of the lower frame to the track roller assembly reduces loads on the pivot shaft between the roller assembly and the tractor frame and reduces loads on the tractor main frame. The lower frame transmits only side and horizontal loads to the tractor mounting. The upper frame, being connected to the blade at only one point and to the tractor frame at two spaced points, transmits reactions to the tractor frame in a sideways and horizontal direction.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 1 is an elevational view of a tractor having a cushioned bulldozer blade mounting assembly showing my invention;

FIG. 2 is an enlarged plan view of the mounting assembly of FIG. 1 with portions of the blade broken away and portions of the tractor in phantom;

DESCRIPTION OF THE PREFERRED EMBODIMENT

Figure 3:
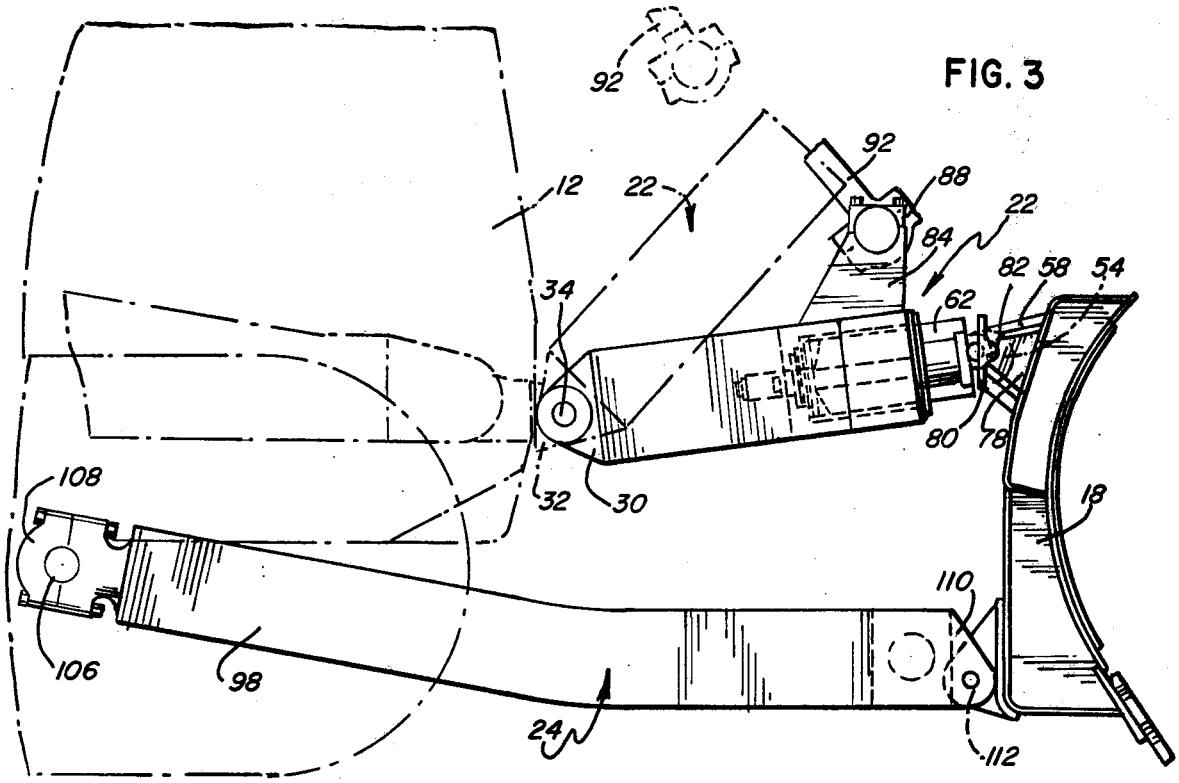
FIG. 3 is an enlarged elevational view of the mounting assembly of FIG. 1.

In FIG. 1 of the drawing, a tractor 10 is shown and has a main frame 12 with a pair of tracks 14 carried by track roller frames 16 connected to the tractor main frame 12 by a pivot shaft, all in a conventional manner. A push blade 18 is carried by the forward ends of a blade mounting assembly 20 which, in turn, is mounted on the tractor main frame 12 and on the track roller frames 16 of the tractor.

Figure 5:
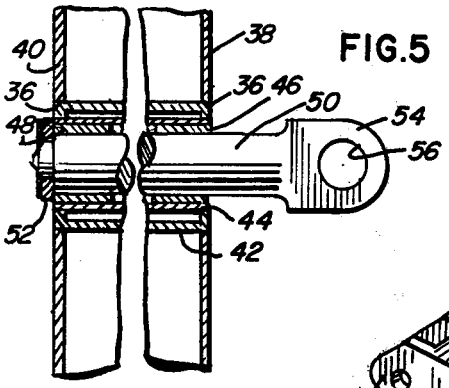
Figure 4:
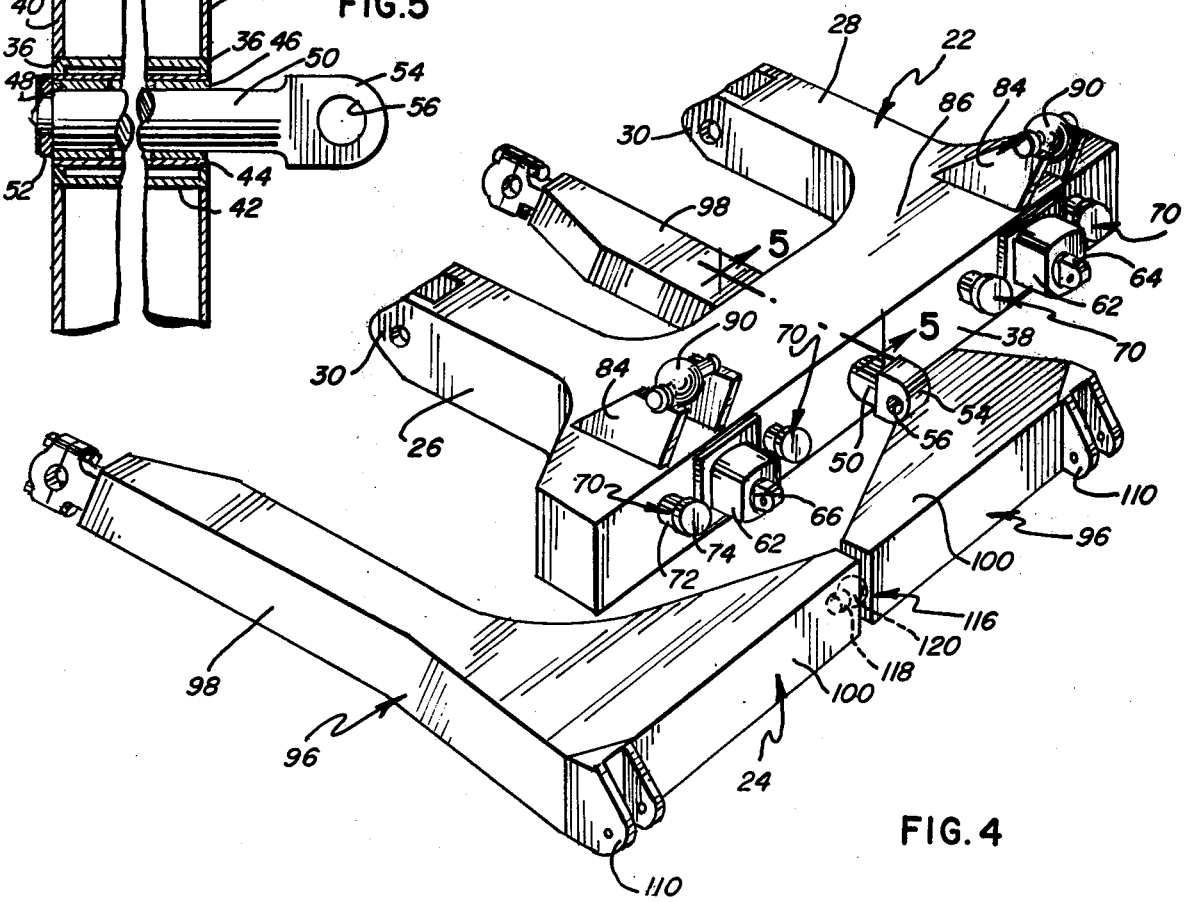
FIG. 4 is a perspective view of the upper and lower frames of the mounting assembly; and, FIG. 5 is an enlarged cross-sectional view taken along the line 5—5 of FIG. 4.

More specifically, the mounting assembly 20 is comprised of an upper frame 22 and a lower frame 24. The upper frame 22 has a C shape with the legs 26,28 of the "C" having bifurcated ends 30 pivotally mounted to lugs 32 on the front of the tractor main frame 12. Pins 34 pass through said bifurcated ends 30 of the "C" and through the lugs 32 so that the upper frame 22 can pivot about the axis of the pins 34. The midportion of the upper frame 22, as can be seen in FIGS. 2, 4 and 5, has openings 36 formed through the front and rear walls 38,40 with a socket member 42 seated therein. The socket 42 has a sleeve 44 supporting a pair of bushings 46,48 on opposite end portions thereof. A trunnion 50 passes through the bushings 46,48 in the socket 42 and has a washer 52 keyed on one end thereof so as to prevent the trunnion 50 from passing through the opening in the socket. The other end of the trunnion 50 has an enlarged head 54 which has a tapped bore 56 therethrough. The trunnion 50 is pivotally mounted to a pair of lugs 58 welded to the upper midportion of the blade 18 with the enlarged head 54 of the trunnion 50 nested between the lugs 58 and a pivot pin 60 passing therethrough. The blade 18 can move back and forth toward and away from the upper frame 22 by means of the trunnion 50 sliding in the socket 42, and the blade 18 can pivot relative to the upper frame 22 about the axis of the trunnion 50.

A pair of cushioning members 62 are carried by the upper frame 22 and are substantially in alignment with the legs 26,28 of the "C". The cushioning members 62 are of a conventional type, one such being shown and described in U.S. Pat. No. 3,158,944 to T. R. Rehberg et al, and assigned to the common assignee of the present application. Each cushioning member 62 has a forwardly projecting rod 64 which has an eye through which a connecting pin 66, passing between spaced lugs 68 carried by the blade, passes. As the blade 18 is forced rearward against the cushioning members 62, the cushioning members 62 will absorb the shock of the loads therein.

Bottoming stop members 70, which are shown to be four in number, are mounted on the forward wall 38 of the upper frame. Each stop 70 is comprised of a resilient body member 72 and a forwardly facing metal end plate 74 with the front of the end plate 74 facing toward the rear of the blade. Mounted on the back of the blade 18, opposite each stop 70, is an abutting stop 76, each one of which is mounted between a pair of spaced lugs 78 carried by the blade. Each stop 76 has a body portion 80 through which a pivot pin 82, carried by the lugs 78, passes so that the abutting stop 76 is free to pivot about the axis of the pin 82 so that the face of the abutting stop 76 can be angularly adjusted depending upon the position of the blade relative to the mounting assembly.

In use, as the blade 18 is forced rearward, the cushioning members 62 will absorb the shock load. However, to increase the cushioning force capability near the end of the stroke, the stop members 70,76 are provided so that hammering damage does not occur when the blade finally reaches a solid stop. The solid stop is provided, in the present construction, when the face of the enlargement 54 of the center pin or trunnion 50 contacts the front wall of the upper frame 22.

Two pairs of upwardly extending mounting brackets 84 are secured on the upper surface 86 of the upper frame 22 with appropriate caps 88 being secured to the ends thereof for trapping an axle-mounted ball 90 therebetween. A pair of lifting cylinders 92 are shown in FIGS. 1 and 3 with one end of each cylinder being mounted to a bracket 94 on the upper part of the main frame 12, and with the other end of each cylinder being operatively connected to the ball 90 on each side of the upper frame 22. By means of hydraulics or any other appropriate actuating system, the lifting cylinders 92 can be activated to raise and lower the front end of the upper frame 22 which, in turn, raises and lowers the blade 18 and lower frame 24.

The mounting assembly 20 includes the lower frame 24 which is comprised of a pair of L-shaped halves 96,96 with each L-shaped half having a long leg 98 and a short leg 100. The rearward end of each long leg 98,98 is connected to the inside of the track roller frame 16 by means of a trunnion 106 carried by the roller frame 16 and a cap 108 bolted on the end of the leg 98 to rotatably encase said trunnion 106. The connection between the legs 98 and the trunnions 106 is such as to pivotally mount the lower push frame 24 relative to the tractor. The forward ends of the long legs 98 of the L-shaped lower push frames 24 have a pair of mounting brackets 110 which are adapted to be connected to the lower outer corners of the blade 18 through ball bushing connections at 112. A hanger bracket may be provided between the L-shaped arms 98 and the blade 18 to properly support the ball bushing connections at 112.

The short legs 100 of each L-shaped push frame are connected together for limited relative movement by means of a sliding pin and ball arrangement 116 of the general type shown and described in U.S. Pat. No. 3,049,821, issued to Robert W. Lichti and assigned to the common assignee of the present invention. The pin and ball connection 116 includes a pin 118 projecting from and carried by the end of the short leg 100 of the L frame 96 with a spherical ball-type bearing 120 mounted in the other short leg 100 of the other L frame 96 so that with the pin 118 on the one leg 100 positioned in the spherical ball-type bearing 120 on the leg 100 of the other L frame 96, some limited relative movement between the L frames 96,96 will be permitted. The movement reduces stresses that would be set up if the lower frame 24 were all one piece as is described in said Lichti U.S. Pat. No. 3,049,821, supra.

With the blade mounting assembly 20 consisting, first, of the upper frame 22 connected between the tractor main frame 12 and the single point through trunnion 50 with the blade and, second, the lower frame 24 connected between the inside of the track roller assembly and the two points at the lower corners of the blade 18, the cushioned bulldozer blade 18 is ready for use. That is, when the tractor moves the blade 18 into contact with, for instance, a scraper, the shock of the initial contact is absorbed, in part, by the cushioning members 62,62 and by the stop members 70,76 with the face of the head 54 of the trunnion 50 bottoming on the upper frame to prevent damage between the blade 18 and the upper frame 22. The reaction force of the cushioning members 62,62 and the force of the push are transmitted, in part, through the upper frame 22 to the main frame 12 of the tractor with the pushing force of the tractor acting through lower frame 24. The mounting of the lower frame is preferably on the track roller frame so that loads applied to the blade go through the lower frame 24, into the track roller frame and then into the track with as little of the load as possible going into the tractor main frame. Racking loads on the main frame are avoided by having the upper frame 22 connected to the blade by the single sliding pivot pin or trunnion 50 and connecting the lower frame 24 to the track roller frame. Previously, racking loads on the main frame were created by connecting the upper frame directly to the blade so that a load on the blade would cause a downward load on one side of the frame resulting in an upward load on the other side of the frame. Unequal loads on the main frame are undesirable. By taking moments around the center pin or trunnion 50 of the upper frame results in the loads on either tractor connection points 30 of the upper frame 22 being equal and in the same direction, therefore, no racking loads are created in the tractor main frame. The upper frame 22 transmits mainly side and horizontal loads to the mounting 30 of the upper frame 22 to the tractor main frame.

The lower frame 24 must be split at 116 and has the sliding pin 118 and center ball arrangement 120 so that one track roller frame can go up as the other track roller frame goes down while the lower frame 24 absorbs the side loads.

The embodiment of the invention in which an exclusive property or privilege is claimed is defined as follows:

1. In a cushion bulldozer blade mounting assembly for attachment of a blade to a tractor, said mounting assembly having a lower frame and an upper frame, said lower frame having a pair of push arms with each arm being pivotally mounted to a track roller frame on the tractor and to one lower corner of said blade, means interconnecting said push arms to permit limited relative motion between said push arms, said upper frame has a C-shape with the legs of the "C" being pivotally connected to the tractor frame at spaced apart points, a trunnion pivotally mounted to the upper midportion of the blade and projecting rearward therefrom, a socket in said upper frame for slidably and rotatably receiving said trunnion whereby said blade is permitted to move longitudinally and rotatably relative to said upper frame, a pair of cushioning means are seated in said upper frame, said cushioning means are equally spaced on opposite sides of said trunnion and are connected to said blade whereby shock loads on the blade will be cushioned by the cushioning means as the trunnion slides longitudinally in said socket, stops are mounted on said upper frame and pivotally mounted mating stops are mounted on said blade in alignment with said stops whereby shock loads on the blade will engage the mating stops with the stops, and means on said trunnion engaging with said upper frame.

2. In a cushion bulldozer blade mounting assembly for attachment of a blade to a main frame and to a track roller frame of a tractor, said mounting assembly having a lower frame and an upper frame, said lower frame having a pair of L-shaped push arms with one leg of each arm being pivotally mounted to the track roller frame, the other end of said leg of each arm being pivotally mounted to one lower corner of said blade, means interconnecting the second legs of said L-shaped arms to permit limited relative movement between said L-shaped arms, said upper frame having a C shape with the legs of the "C" being pivotally connected at spaced apart points to said main frame of the tractor, a trunnion projecting rearwardly from the upper midportion of the blade and being pivotally mounted to said blade along an axis lying parallel to a top edge of the blade, a socket in said upper frame for slidably receiving said trunnion for longitudinal and rotatable movement of said blade along and about the axis of said trunnion, cushioning means carried by said upper frame and connected to said blade whereby shock loads on said blade are cushioned before reaching said tractor frame, and means connected between said upper frame and said tractor frame for raising and lowering said blade.

3. In a cushion blade mounting assembly as claimed in claim 2 wherein stop means are mounted on said upper frame and on said blade in alignment with each other whereby strong shock loads will cause said stop means to contact each other.

* * * * *